US011378103B2

(12) United States Patent
Mathisen et al.

(10) Patent No.: US 11,378,103 B2
(45) Date of Patent: Jul. 5, 2022

(54) SUBSEA HYDRAULIC CONTROL DEVICE AND A METHOD FOR PRODUCING THEREOF

(71) Applicant: FMC Kongsberg Subsea AS, Kongsberg (NO)

(72) Inventors: Stig Fredrik Mathisen, Kongsberg (NO); Heyn Halfdan Magnus, Kongsberg (NO); Dharmesh Gadaria, Kongsberg (NO); Simen Landa, Oslo (NO); Kandasamy Balendran, Larvik (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 419 days.

(21) Appl. No.: 16/630,459

(22) PCT Filed: Jun. 20, 2018

(86) PCT No.: PCT/EP2018/066338
§ 371 (c)(1),
(2) Date: Jan. 12, 2020

(87) PCT Pub. No.: WO2019/011598
PCT Pub. Date: Jan. 17, 2019

(65) Prior Publication Data

US 2021/0079933 A1 Mar. 18, 2021

(30) Foreign Application Priority Data

Jul. 12, 2017 (NO) ..... 20171156

(51) Int. Cl.
*F15B 13/02* (2006.01)
*E21B 33/03* (2006.01)
*E21B 33/035* (2006.01)

(52) U.S. Cl.
CPC ..... *F15B 13/02* (2013.01); *E21B 33/0355* (2013.01); *F15B 2211/50* (2013.01)

(58) Field of Classification Search
CPC ... F15B 13/02; F15B 2211/50; E21B 33/0355
See application file for complete search history.

(56) References Cited

U.S. PATENT DOCUMENTS 3,993,091 A * 11/1976 Loveless ..... F15C 3/04 137/271
4,404,989 A * 9/1983 LeMoine ..... F16L 37/56 166/344

(Continued)

FOREIGN PATENT DOCUMENTS

WO WO 2010/042873 A2 4/2010

*Primary Examiner* — Aaron L Lembo

(57) ABSTRACT

The present invention relates to a subsea hydraulic control device (10) for hydraulically controlling a subsea module (2). The control device (10) comprises a hydraulic distribution unit (12) with a valve unit (13) and a manifold unit (50), where hydraulic fluid lines are provided in the valve unit (13) and in the manifold unit (50). The hydraulic distribution unit (12) comprises a low pressure hydraulic input port (21) connectable to a low pressure fluid source (LP) and connected to a low pressure fluid line (22) within the hydraulic distribution unit (12), a high pressure hydraulic input port (31) connectable to a high pressure fluid source (HP) and connected to a high pressure fluid line (32) within the hydraulic distribution unit (12), a return port (41) connectable to a return fluid reservoir (R) and connected to a return fluid line (42) within the hydraulic distribution unit (12) and a number of hydraulic output ports (24, 34) connectable to subsea actuators (A) of the subsea module (2). A section of the low pressure fluid line (22) is provided as a first fluid bore (B22) in the manifold unit (50) and a section of the high pressure fluid line (32) is provided as a second fluid bore (B32) in the manifold unit (50). The configuration of the (Continued)

respective bores (B22, B32) in the manifold unit (50) is determining which of the output ports (24, 34) being a low pressure output port (24) connected to the low pressure fluid line (22) and which of the output ports (24, 34) being a high pressure output port (34) connected to the high pressure fluid line (32).

10 Claims, 13 Drawing Sheets

(56) References Cited

U.S. PATENT DOCUMENTS

| | | | | |
|---|---|---|---|---|
| 4,413,642 | A * | 11/1983 | Smith | E21B 34/16 251/1.1 |
| 6,328,070 | B2 | 12/2001 | Clayton et al. | |
| 9,580,995 | B2 * | 2/2017 | Kanstad | E21B 41/0007 |
| 11,242,950 | B2 * | 2/2022 | Johnson | F16L 37/002 |
| 2008/0223467 | A1 | 9/2008 | Tveita | |
| 2011/0114329 | A1 | 5/2011 | Emecheta et al. | |
| 2014/0151050 | A1 | 6/2014 | Borsheim | |
| 2014/0246202 | A1 | 9/2014 | Borsheim | |
| 2020/0309319 | A1 * | 10/2020 | Pitcher | F16N 7/38 |
| 2020/0347690 | A1 * | 11/2020 | Landa | F16K 31/007 |

* cited by examiner

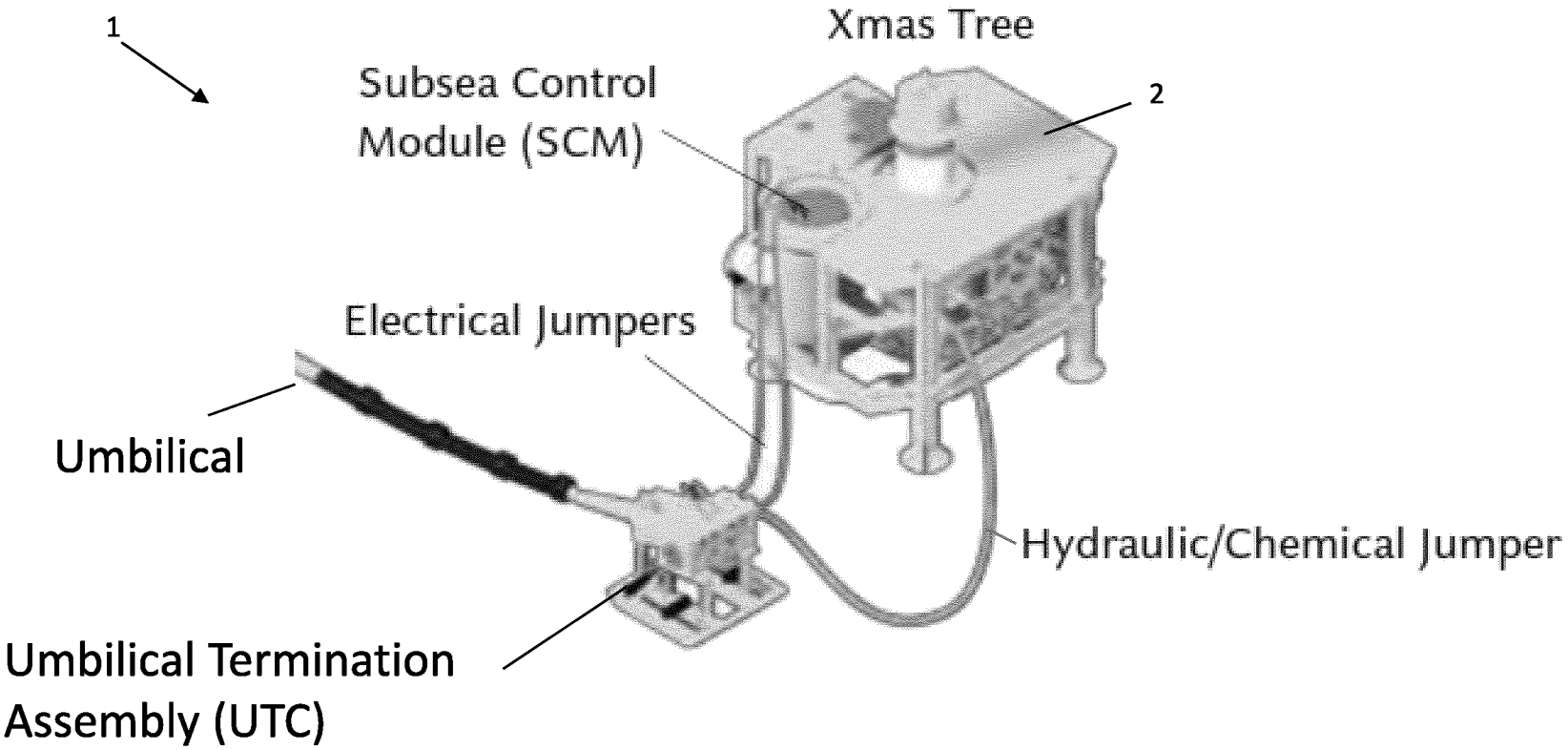
Fig. 1: Prior art

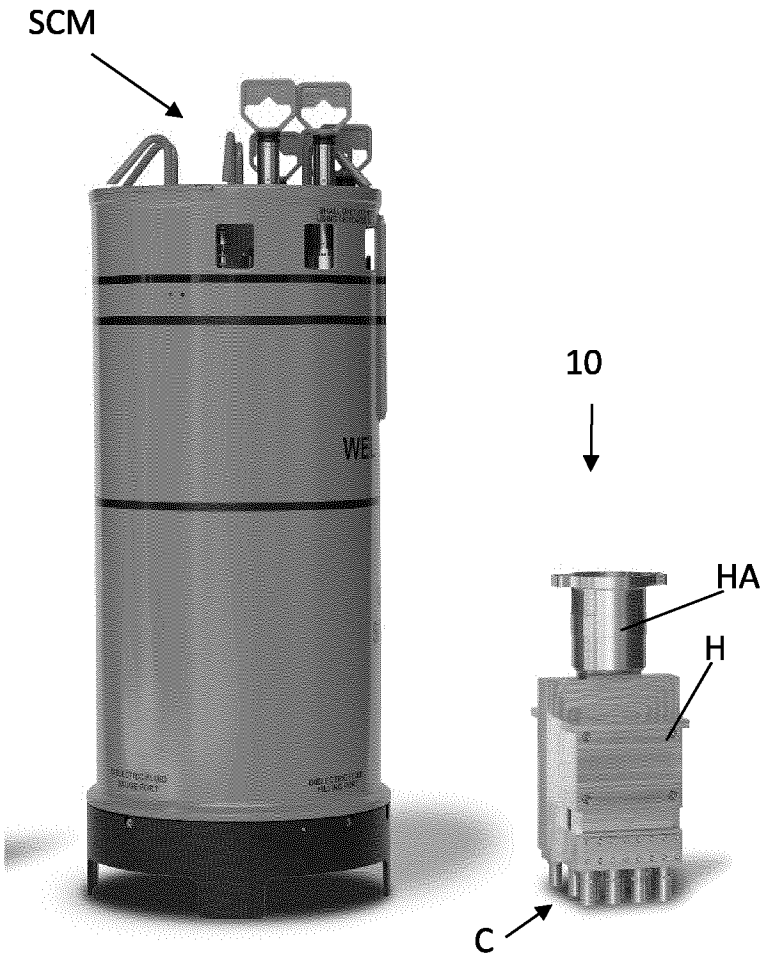
Fig. 3
Fig. 2b: Prior art
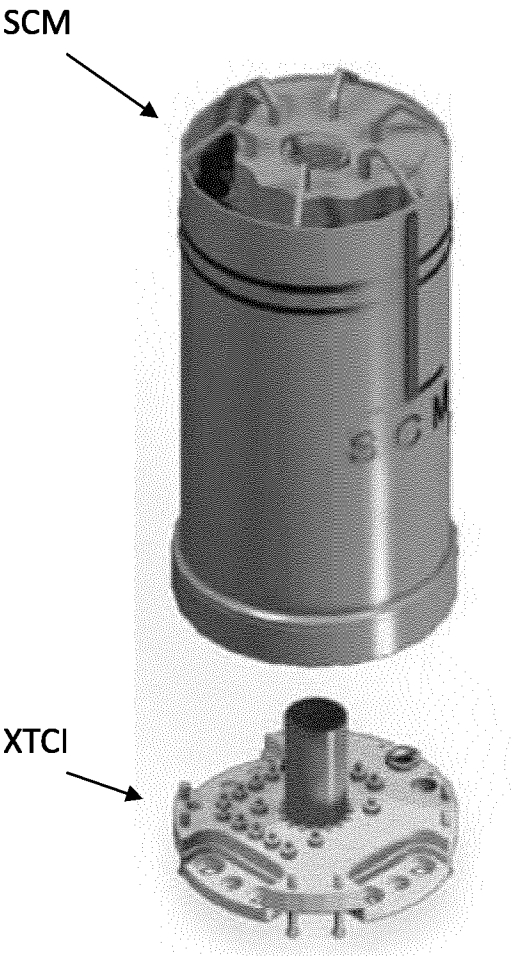
Fig. 2a: Prior art

SUBSEA HYDRAULIC CONTROL DEVICE AND A METHOD FOR PRODUCING THEREOF

FIELD OF THE INVENTION

The present invention relates to a subsea hydraulic control device for hydraulically controlling a subsea module. The present invention also relates to a method for production of a subsea hydraulic control device.

BACKGROUND OF THE INVENTION

Different types of subsea modules are used in subsea oil/gas installations. In FIG. 1, a part of a subsea oil/gas installation 1 is shown, with one typical subsea module 2 is the Christmas tree connected to a well head (not shown) of an oil/gas well. In FIG. 1, it is shown that the Christmas tree is connected to an umbilical termination assembly (UTC) via electrical jumpers and hydraulic/chemical jumpers. The umbilical is connected between the UTC and a topside installation (not shown).

A subsea control module (SCM) is connected to a connection interface XTCI (FIG. 2*a*) of the Christmas tree 2. The SCM shown in FIGS. 2*a* and 2*b* has been manufactured and sold by FMC Technologies for many years. The SCM contains electronics, instrumentation, and hydraulics for safe and efficient operation of subsea tree valves, chokes, and also downhole valves in the well, all control operations for keeping the well under control.

The SCM is supplied with a high pressure fluid from a high pressure input fluid line and a low pressure fluid from a low pressure input fluid line. These high pressure and low pressure fluids may arrive to the SMC from the umbilical via the UTC and hydraulic jumper (FIG. 1). The SCM comprises a high pressure manifold with respective control valves and a low pressure manifold with respective control valves for distributing and controlling the fluid supplied to the respective tree valves, chokes and downhole valves. Typically, the high pressure fluid is used to control downhole valves, and the low pressure fluid is used to control valves and chokes of the subsea module.

U.S. Pat. No. 6,328,070 describes a valve arrangement for controlling hydraulic fluid flow to a subsea system including a plurality of docking modules each having a valve element for controlling the flow of a fluid and a docking module port for fluid flow between the valve element. The valve arrangement additionally includes a manifold having manifold ports of uniform cross section. The docking modules can be interchangeably mounted to the manifold ports as desired to tailor the valve arrangement for any selected valve operation. The valve arrangement also includes an adapter for alternately sealingly interconnecting a first docking module port which is different in shape or area than the cross section of the uniform size manifold port to any selected manifold port so as to permit sealed fluid flow between the first docking module port and the manifold port in one configuration of the valve arrangement and sealingly interconnecting a second docking module port of a different cross-sectional shape or area than the first docking module port to the same selected manifold port so as to permit sealed fluid flow between a second valve element and the first manifold port in another configuration of the valve arrangement.

The oil and gas industry is facing several challenges with respect to reducing costs for subsea equipment and subsea operations. Hence, one object is to reduce the size and cost of control devices for subsea modules. Another object of the invention is to standardize the design of such control devices while at the same time allowing the owner and/or operator of the oil/gas field to adapt the control devices according to their specifications.

SUMMARY OF THE INVENTION

The present invention relates to a subsea hydraulic control device for hydraulically controlling a subsea module, where the control device comprises a hydraulic distribution unit comprising a valve unit and a manifold unit, where hydraulic fluid lines are provided through the valve unit and the manifold unit;

where the hydraulic distribution unit comprises:

- a low pressure hydraulic input port connectable to a low pressure fluid source and connected to a low pressure fluid line within the hydraulic distribution unit;
- a high pressure hydraulic input port connectable to a high pressure fluid source and connected to a high pressure fluid line within the hydraulic distribution unit;
- a return port connectable to a return fluid reservoir and connected to a return fluid line within the hydraulic distribution unit;
- a number of hydraulic output ports connectable to subsea actuators of the subsea module;

where the valve unit comprises a number of control valves, where each control valve is connected either between the low pressure fluid line, the return fluid line and one of the output ports or between the high pressure fluid line, the return fluid line and one of the output ports;

where the manifold unit comprises sections of the low pressure and high pressure fluid lines for distributing fluid from the input ports to the respective control valves;

where a section of the low pressure fluid line is provided as a first fluid bore in the manifold unit and a section of the high pressure fluid line is provided as a second fluid bore in the manifold unit;

where the configuration of these respective bores in the manifold unit determines which of the output ports are low pressure output ports connected to the low pressure fluid line and which of the output ports are high pressure output ports connected to the high pressure fluid line.

The manifold unit may be configured as a plate or block element, where the bores are provided within the plate or block element.

In one aspect, the device further comprises a lower base plate, where the valve unit is mounted to the lower base plate and where the manifold unit is connected to a connection surface of the valve unit. The lower base plate will typically be oriented horizontally during lowering to the subsea module and when connected to the subsea module.

In one aspect, the connection surface of the valve unit is accessible for connection of the manifold unit to the valve unit when the valve unit is mounted to the lower base plate. The connection surface may be provided as an accessible side surface substantially perpendicular to the lower baseplate (i.e. the connection surface is oriented substantially vertically), or an accessible top surface substantially parallel with the lower baseplate (i.e. the connection surface is oriented substantially horizontally), or as an accessible inclining surface (i.e. the connection surface is oriented at an angle between 0° and 90° with respect to the lower base plate).

In one aspect, the device also comprises a valve actuator unit comprising valve actuators connected to stems of the respective control valves protruding from the valve unit. These stems can be oriented in a vertical direction, in a horizontal direction or in an inclining direction, dependent on the valve configuration and orientation. In one aspect, the valves in the valve unit are ball valves with a rotation stem connected to a ball valve body and protruding out of a valve housing. The valves for the high pressure line and the low pressure line may be the same valves. The valve may be configured with a valve body within a housing, the housing having in inlet opening, an actuator opening and a return opening. And the valve body configured such that the fluid being either guided from the inlet opening to the actuator opening or from the actuator opening to the return opening. The inlet opening would either be connected to the high or low pressure inlet port, the actuator opening to an output port and the return opening to the return port of the hydraulic distribution unit.

In one aspect, the device comprises a control system housing comprising a control system for controlling valves by means of the valve actuators. The valve actuators may for example be electric motors for rotating the stems, while the control system comprises an control circuit for controlling the electric motors based on control signals received from topside or based on input signals from sensors etc.

At least some of the input ports, the output ports and/or the return ports of the hydraulic distribution unit are connected to stab connectors protruding downwardly from the lower base plate. These stab connectors are herein considered to be a part of the hydraulic distribution unit. The stab connectors may be a part of the valve unit, or they may be connected to the valve unit, i.e. they are provided in fluid communication with the fluid lines of the valve unit.

In one aspect, a supporting structure is connected to the lower base plate. The supporting structure is used for lifting the device up and down with respect to the subsea module, thereby connecting and disconnecting the stab connectors to corresponding connectors of the subsea module.

As a first stage in an assembly of the control device, the valve unit including the stab connectors, the valve actuator unit, the supporting structure and control system housing may be assembled to/on the lower base plate. When these elements are assembled, it is not necessarily yet determined which of the output ports are low pressure output ports and which of the output ports are high pressure output ports This is determined by the configuration of the manifold unit itself by the configuration of the bores in the manifold unit, which can be connected to the valve unit in a subsequent or final step.

It should be noted that the control of how to rotate a stem of a valve, for example angle of rotation, speed of rotation, etc., is independent on whether or not the valve is connected to a high pressure fluid line or a low pressure fluid line. Hence, for the purpose of performing the rotation of the stem, no software or hardware update is needed based on the configuration of the manifold unit.

Hence, the control of how to rotate a stem of a valve is different from the control of when to rotate a stem. The control of when to rotate a stem of a valve is, as mentioned above, based on control signals received from topside or based on input signals from sensors etc.

Hence, such partially assembled devices may be manufactured and stored, and the decision of the desired number of high pressure output ports, low pressure output ports etc can be postponed, as this is determined by the manifold unit which is connected to the device during one of the final assembly steps. In prior art, the decision of the desired number of high pressure output ports and low pressure output ports had to be done in the planning process before the manufacturing even started. Another advantage with the device according to the present invention is standardization—the same device can be used whether you want one high pressure output port and three low pressure output ports or three high pressure output ports and eight low pressure output ports.

In one aspect, the manifold unit is releasably connected to the valve unit. In this way, the valve unit can be reconfigured by replacing one manifold unit with another manifold unit with a different configuration. Alternatively, the manifold unit can be welded to the valve unit.

In one aspect, the valve unit comprises a first sub-unit and a second sub-unit, where a first manifold unit is connected to the surface of the first sub-unit and where a second manifold unit is connected to the surface of the second sub-unit. The first and second sub-units may be located on opposite sides of the supporting structure. The valve units and manifold units may be mirrored images of each other in such a configuration.

In one aspect, in the manifold, the first fluid bore is aligned with the second fluid bore along a common axis and respective first and second lengths of the first and second bores are determining determine which of the output ports are the low pressure output ports and which of the output ports are the high pressure output ports.

In one aspect, the first fluid bore is provided as a bore from a first side end of the manifold unit and the second fluid bore is provided as a bore from a second side end opposite of the first side end of the manifold unit.

The return fluid line may also be provided via the manifold unit. In one embodiment, a section of the return fluid line is provided as one common return fluid line bore for all control valves in the manifold unit. In an alternative embodiment, a first section of the return fluid line is provided as a first return fluid line bore in the manifold unit and a second section of the return fluid line is provided as a second return fluid line bore in the manifold unit. Here, the return fluid lines returning fluids from the high pressure ports are separated from the return fluid lines returning fluids from the low pressure fluid ports. Alternatively, the return fluid line may be provided through the valve unit from the output port to the return port, i.e. not via the manifold unit.

In one aspect, the return port comprises:

- a first return port connectable to a low pressure return fluid reservoir and connected to a first return fluid line within the hydraulic distribution unit;
- a second return port connectable to a high pressure return fluid reservoir and connected to a second return fluid line within the hydraulic distribution unit;

where the control valves connected to the low pressure fluid line are connected to the first return fluid line and the control valves connected to the high pressure fluid line are connected to the second return fluid line.

In one aspect, the fluid lines of the valve unit is guided into the manifold unit via bores provided between a rear surface of the manifold unit facing towards the valve unit and the first and second fluid bores and via bores provided between the rear surface and the return fluid line bore.

The present invention also relates to a method for production of a subsea hydraulic control device, comprising the initial steps of:

- providing a hydraulic distribution unit comprising a valve unit with a number of control valves and fluid lines;
- providing the hydraulic distribution unit with a low pressure hydraulic input port connected to a low pressure fluid line within the hydraulic distribution unit, where the low pressure hydraulic input port is connectable to a low pressure fluid source;

providing the hydraulic distribution unit with a high pressure hydraulic input port connected to a high pressure fluid line within the hydraulic distribution unit, where the high pressure hydraulic input port is connectable to a high pressure fluid source;

providing the hydraulic distribution unit with a return port connected to a return fluid line within the hydraulic distribution unit, where the return port is connectable to a return fluid reservoir;

providing the hydraulic distribution unit with a number of hydraulic output ports connectable to a subsea actuator of a subsea module and having the valves of the valve unit positioned and connected to each output ports where the method further comprises the subsequent step of:

providing a manifold unit comprising sections of the low pressure and high pressure fluid lines for distributing fluid from the input ports to the respective control valves;

providing bores in the manifold unit, where the respective bores in the manifold unit determine which of the output ports are low pressure output ports connected to the low pressure fluid line and which of the output ports are high pressure output ports connected to the high pressure fluid line; and connecting the manifold unit to the valve unit.

In one aspect, the method comprises the step of:

connecting a valve actuator unit comprising valve actuators above the valve unit, where the respective valve actuators are connected to stems of the respective control valves protruding outfrom the valve unit.

In one aspect, the method comprises the step of:

providing a return fluid line bore in the manifold unit.

DETAILED DESCRIPTION

Embodiments of the invention will now be described in detail with reference to the enclosed drawings, where:

FIG. 1 illustrates a part of a prior art oil/gas installation;

FIGS. 2*a* and 2*b* illustrates the prior art subsea control module;

FIG. 3 illustrates a subsea hydraulic control device;

Figure 6A:
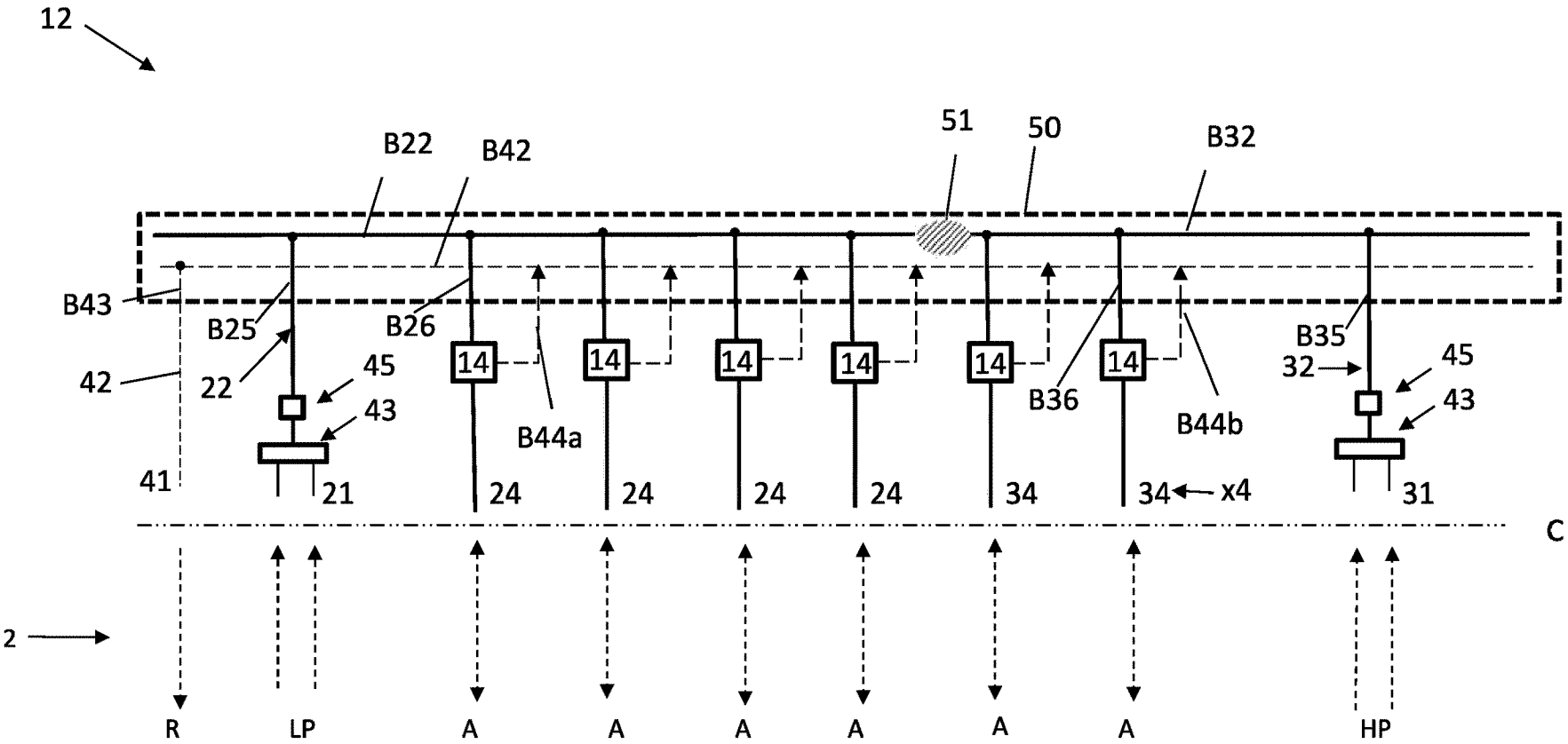
Figure 6B:
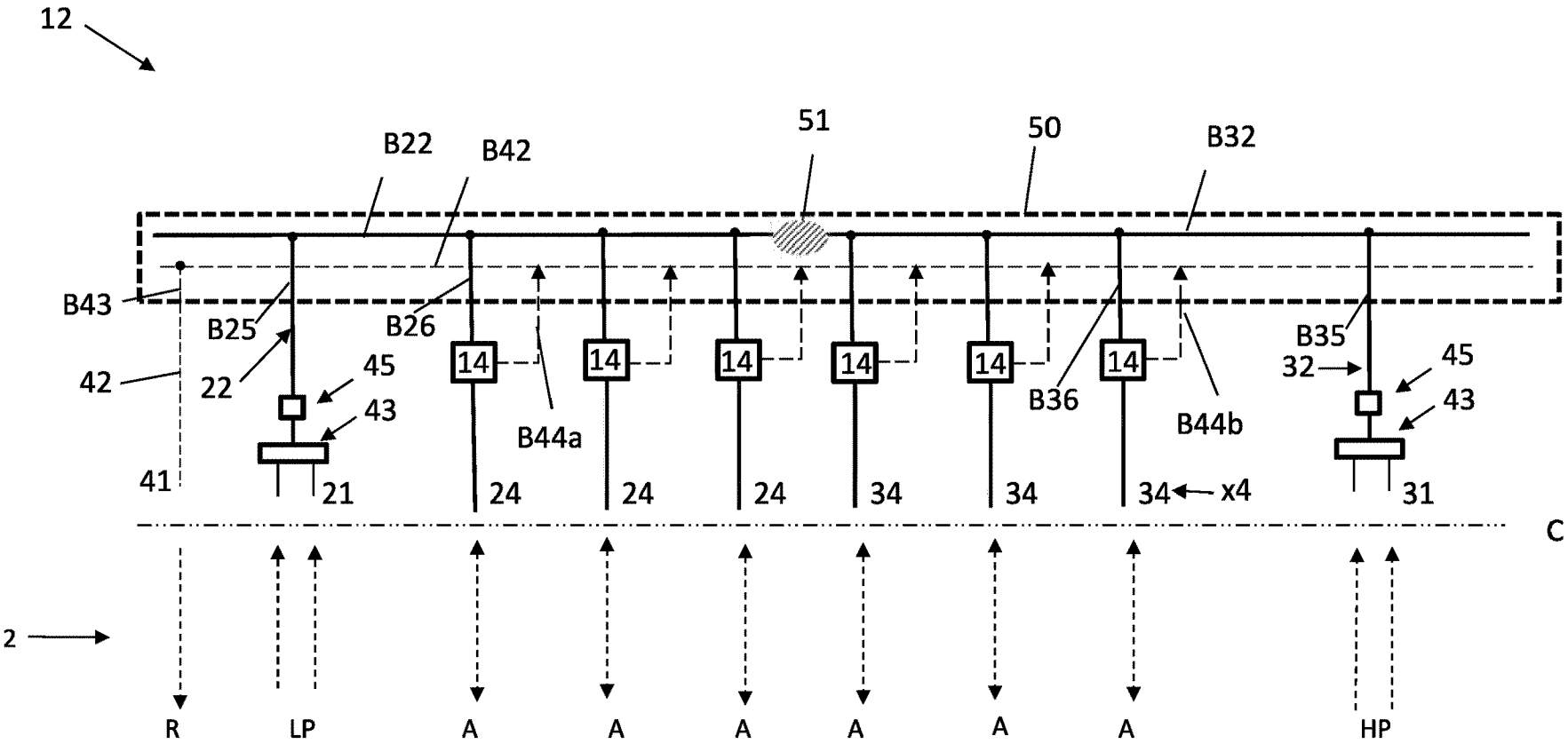

FIG. 6*a* illustrates a simplified fluid line diagram of a first embodiment of the subsea hydraulic control device;

FIG. 6*b* illustrates a simplified fluid line diagram of a alternative embodiment of FIG. 6*a;*

Figure 7:
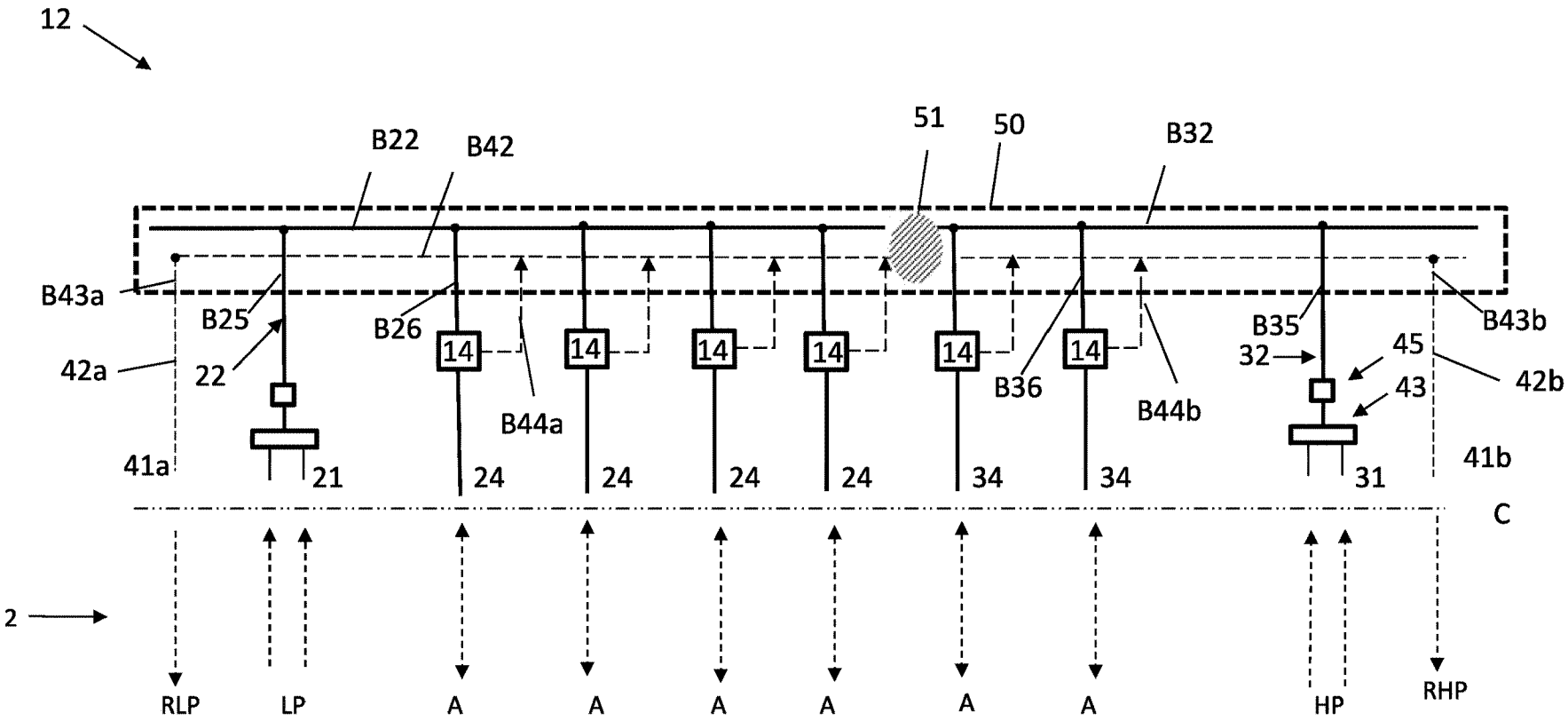
Figure 8:
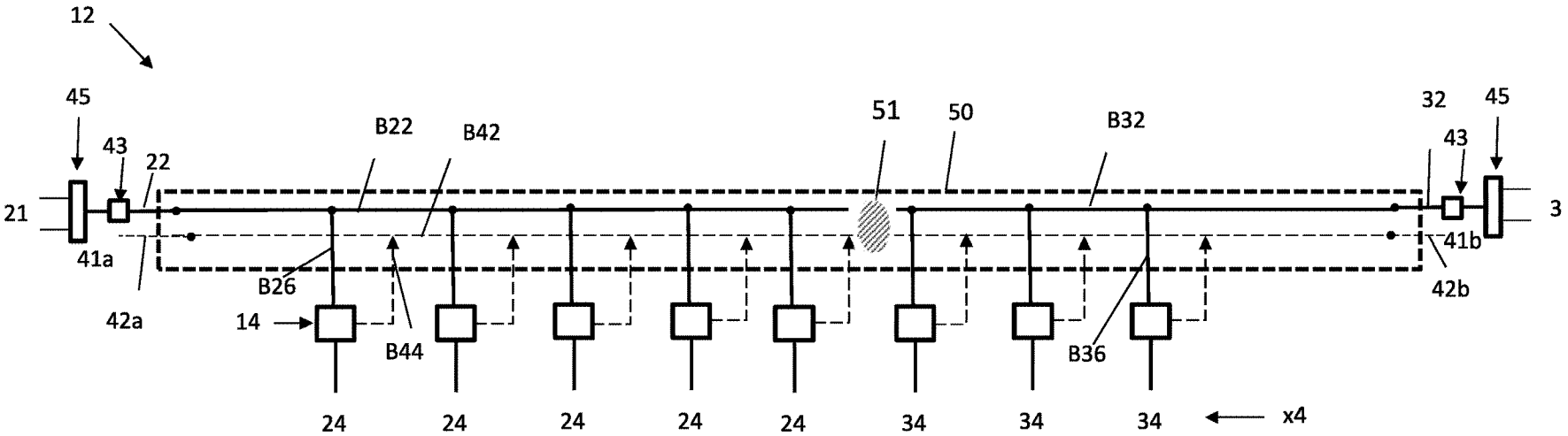
Figure 9B:
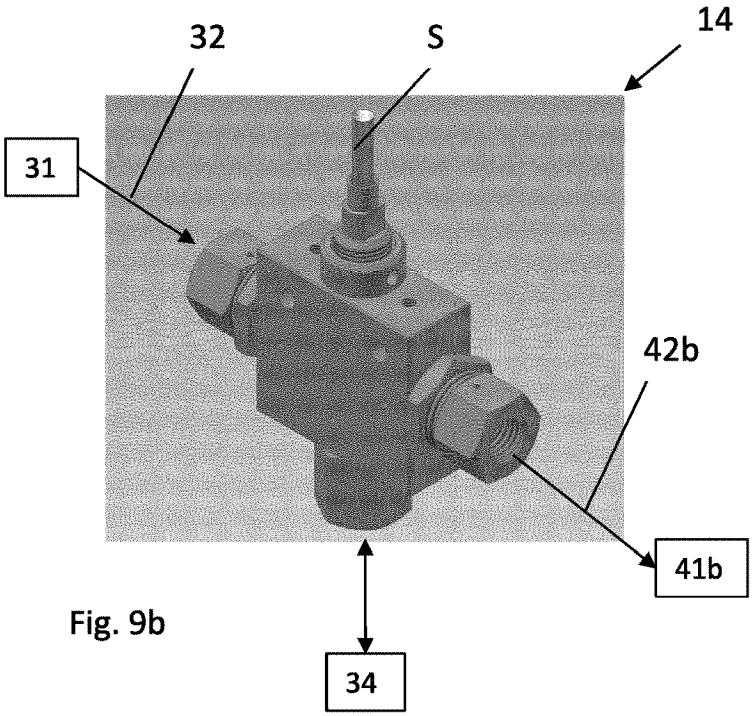
Figure 9A:
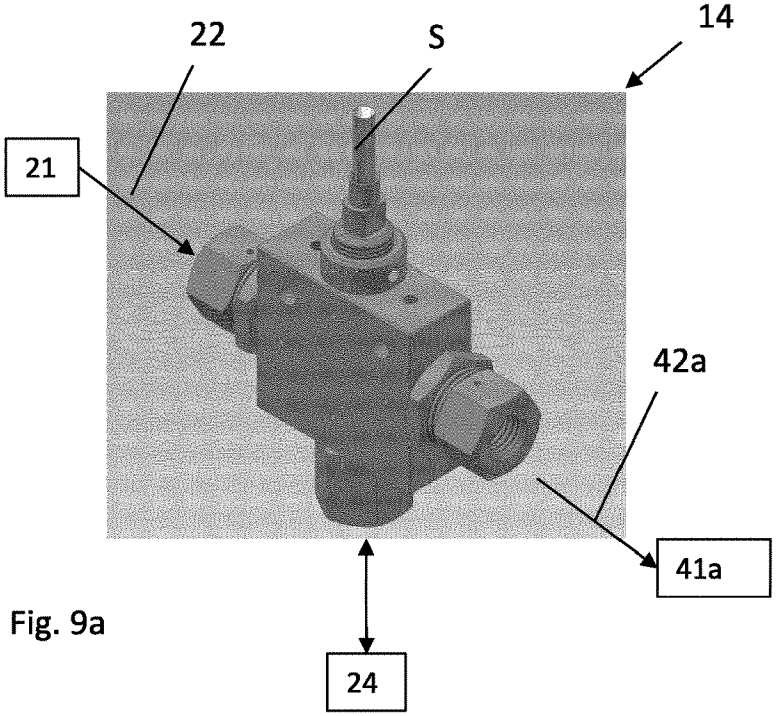
Figure 10:
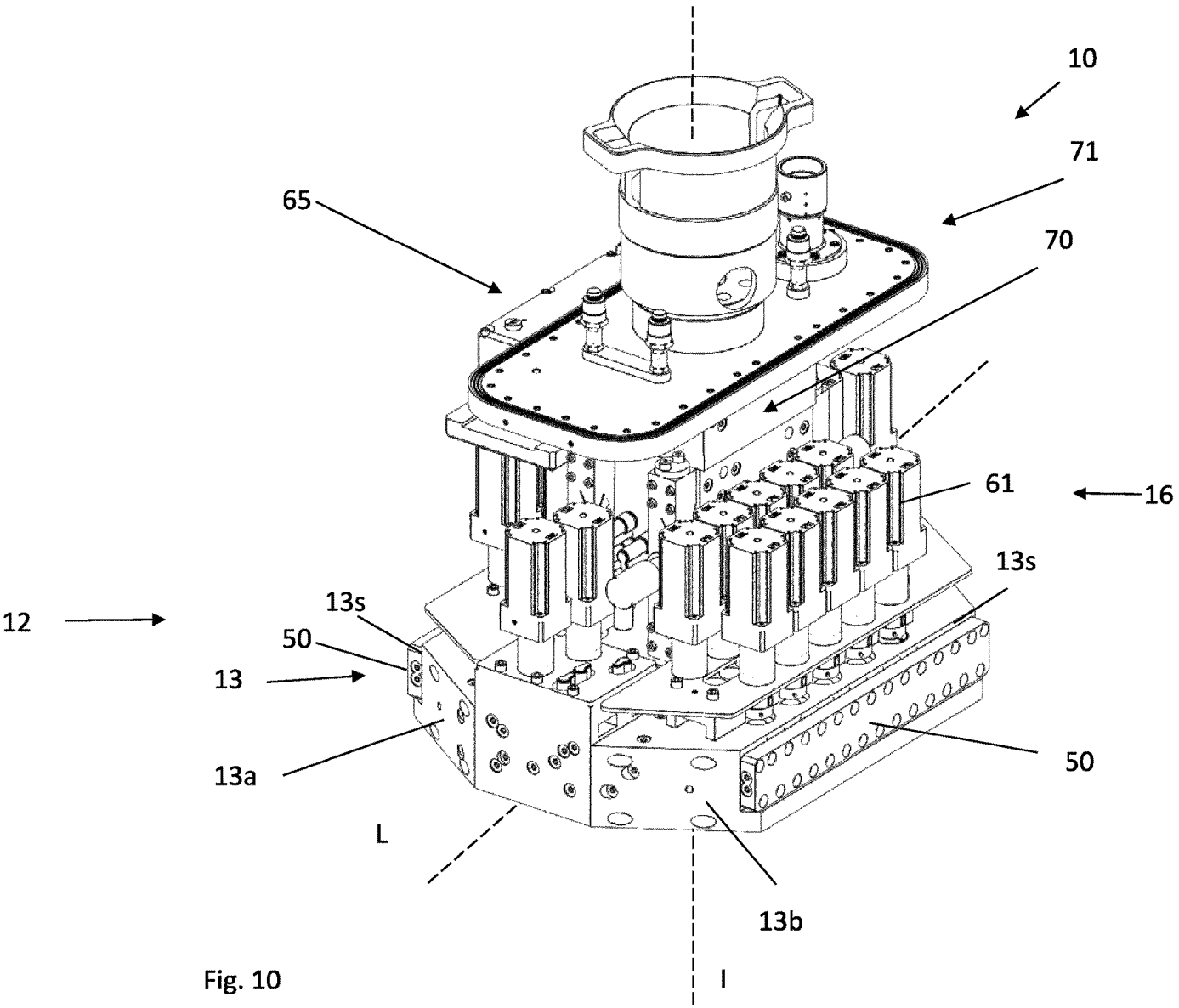
Figure 11B:
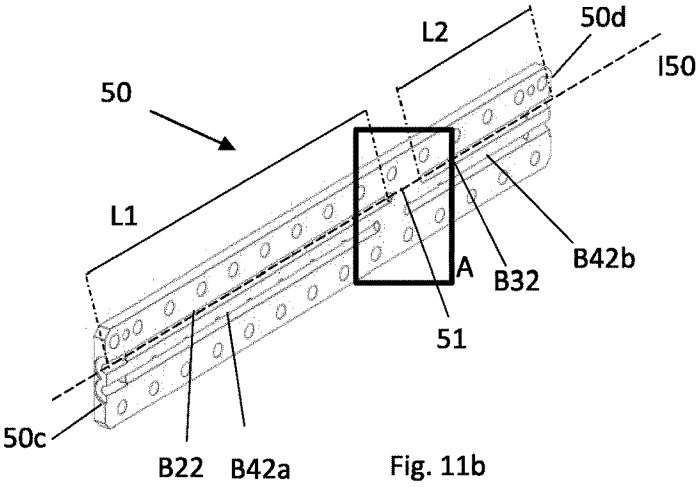
Figure 11E:
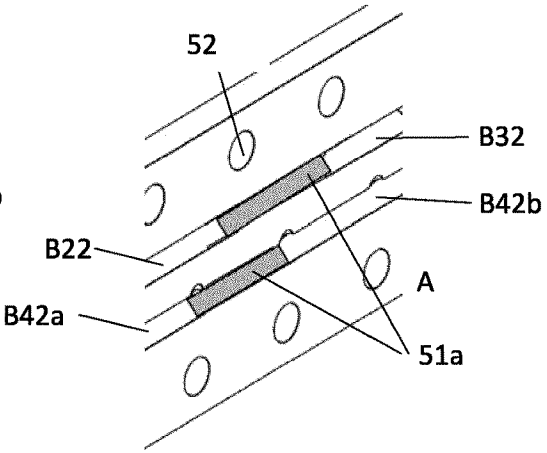
Figure 11D:
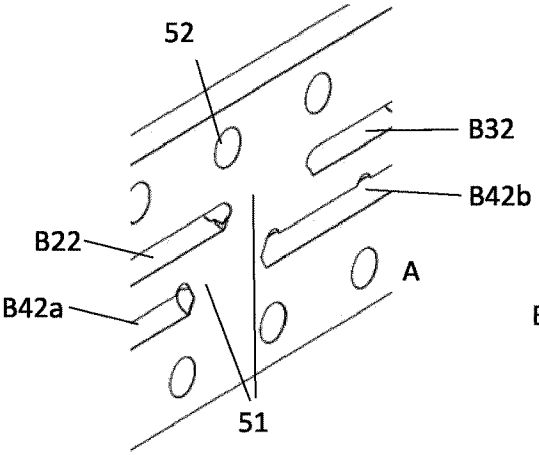
Figure 11A:
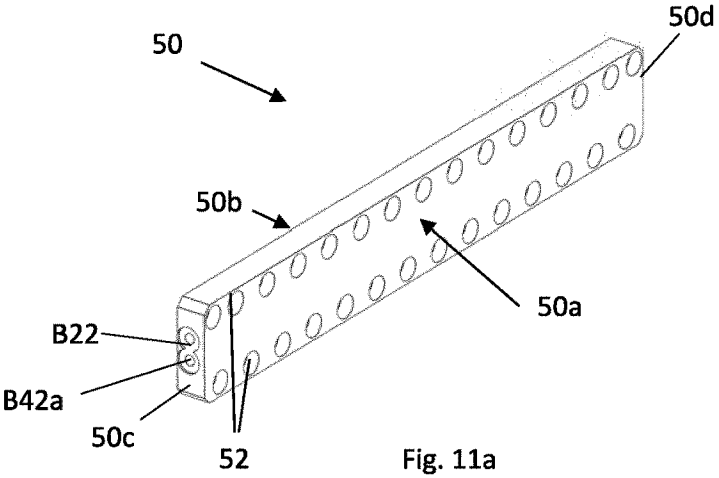
Figure 11C:
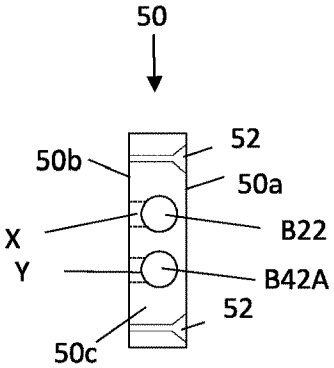

FIG. 7 illustrates a simplified fluid line diagram of a second embodiment of the subsea hydraulic control device;

FIG. 8 illustrates the simplified fluid line diagram of a third embodiment of the subsea hydraulic control;

FIG. 9*a* and FIG. 9*b* illustrates a perspective view of the valve connected to a low pressure fluid line and high pressure fluid line, respectively;

FIG. 10 illustrates a perspective view of a second embodiment of a subsea hydraulic control device, where some parts have been removed;

FIG. 11*a* illustrates a perspective view of the manifold unit;

FIG. 11*b* illustrates a cross sectional perspective view of the manifold unit;

FIG. 11*c* illustrates a side view of the manifold unit;

FIG. 11*d* illustrates an enlarged view of detail A of FIG. 11*b;*

FIG. 11*e* illustrates an alternative embodiment of FIG. 11*d;*

Figure 11F:
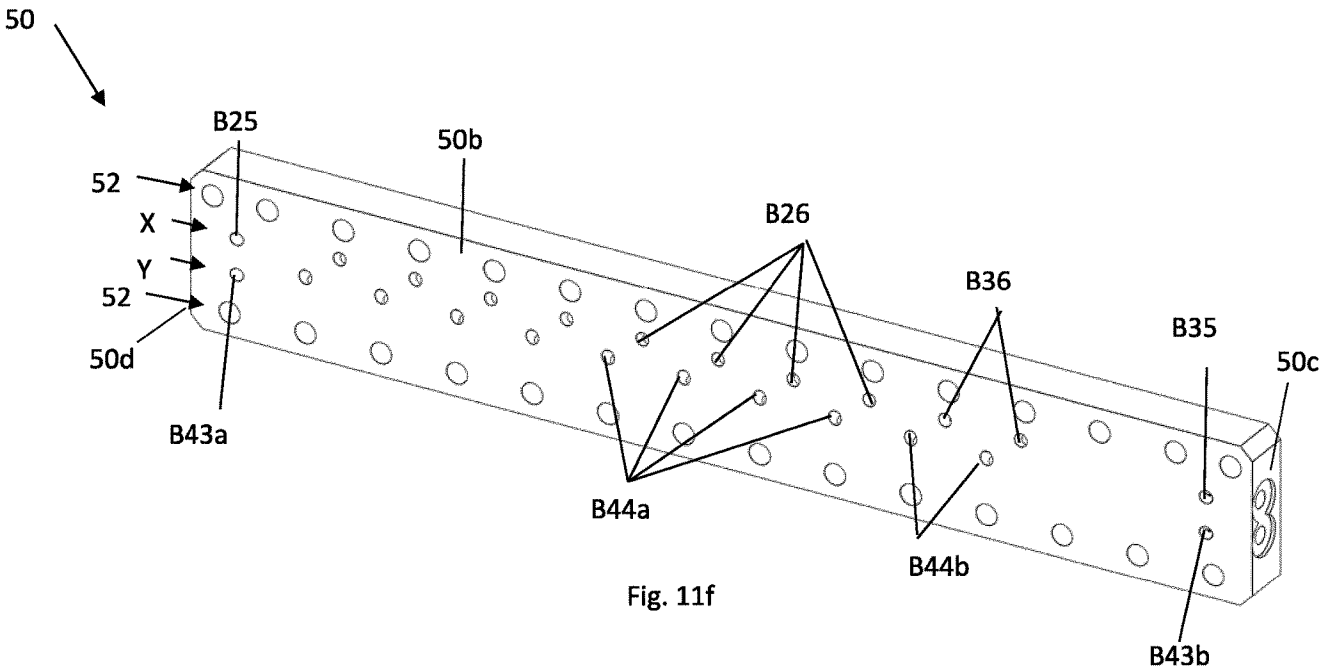
Figure 11G:
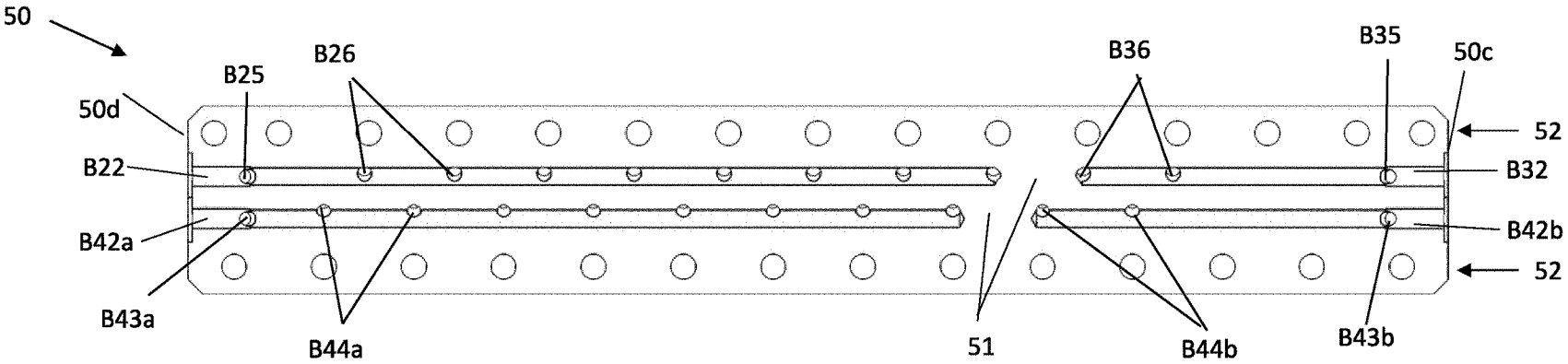
Figure 12A:
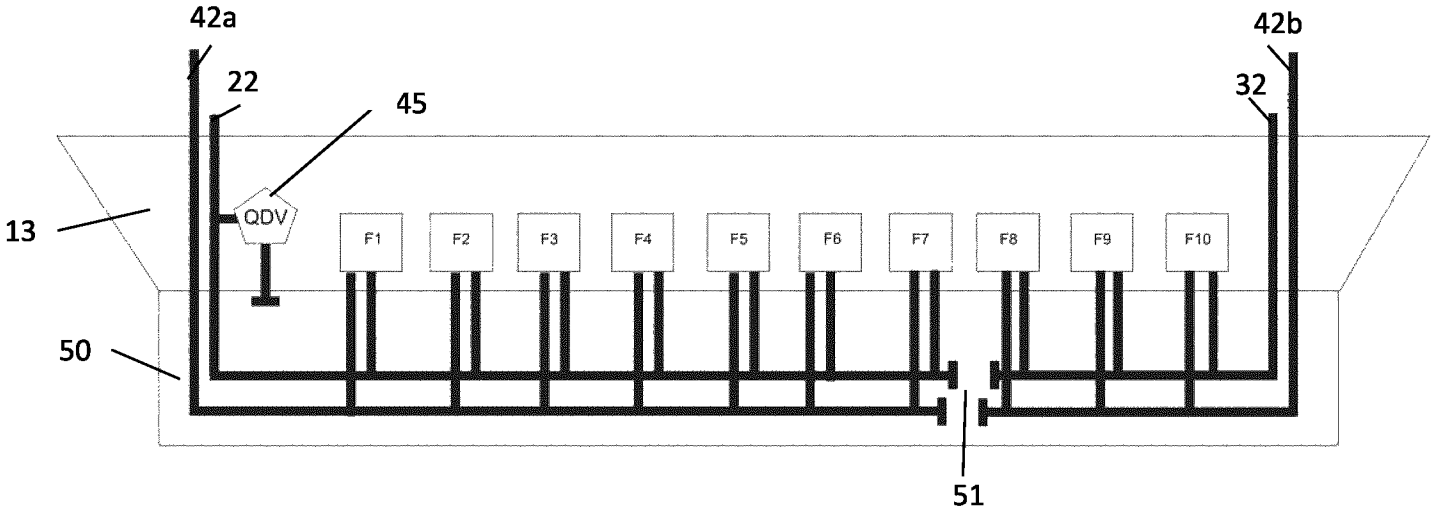
Figure 12B:
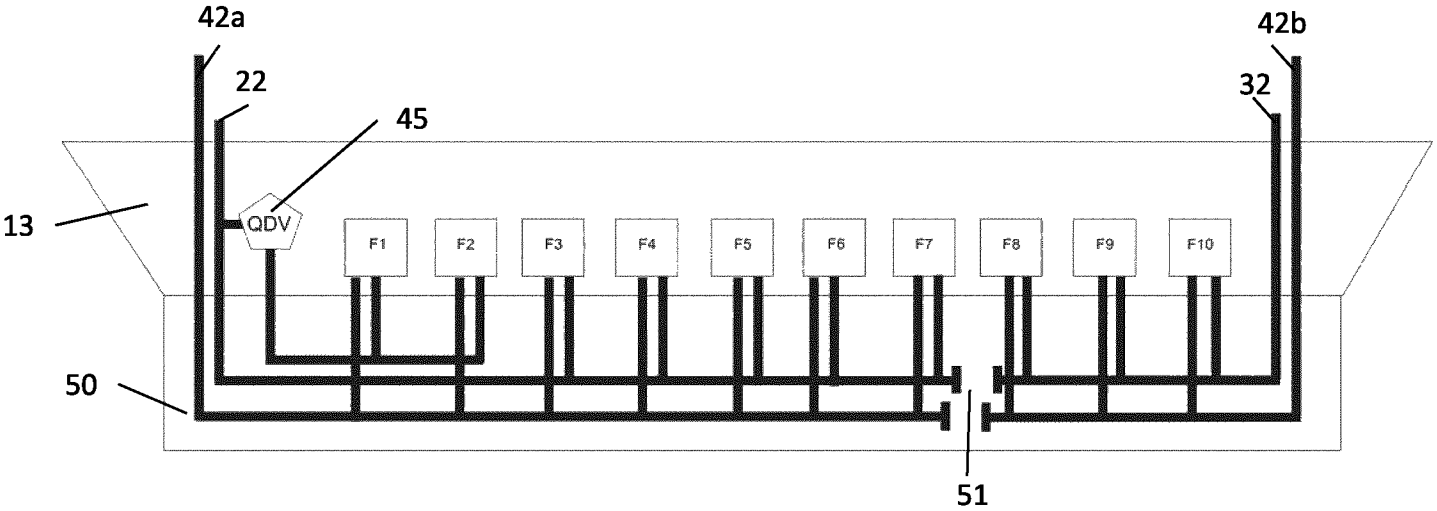

FIG. 11*f* illustrates a perspective view of the rear side of the manifold unit;

FIG. 11*g* illustrates a cross sectional view of the manifold unit;

FIG. 12*a* illustrates an embodiment corresponding to the embodiment of FIG. 7;

FIG. 12*b* illustrates an alternative embodiment to FIG. 12*a*.

Figure 4:
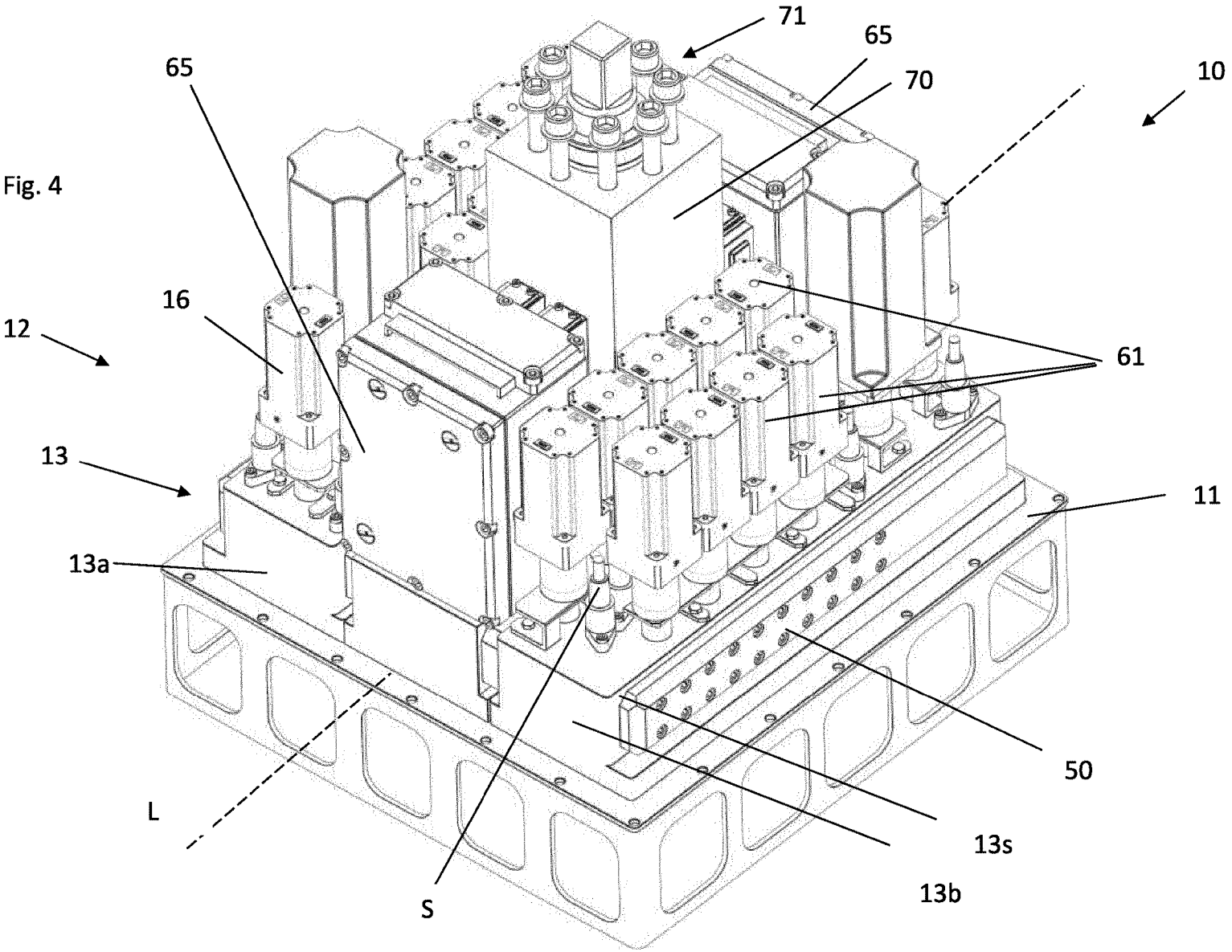
FIG. 4 illustrates a perspective view of a first embodiment of a subsea hydraulic control device, where the outer pressure barrier has been removed.
Figure 5:
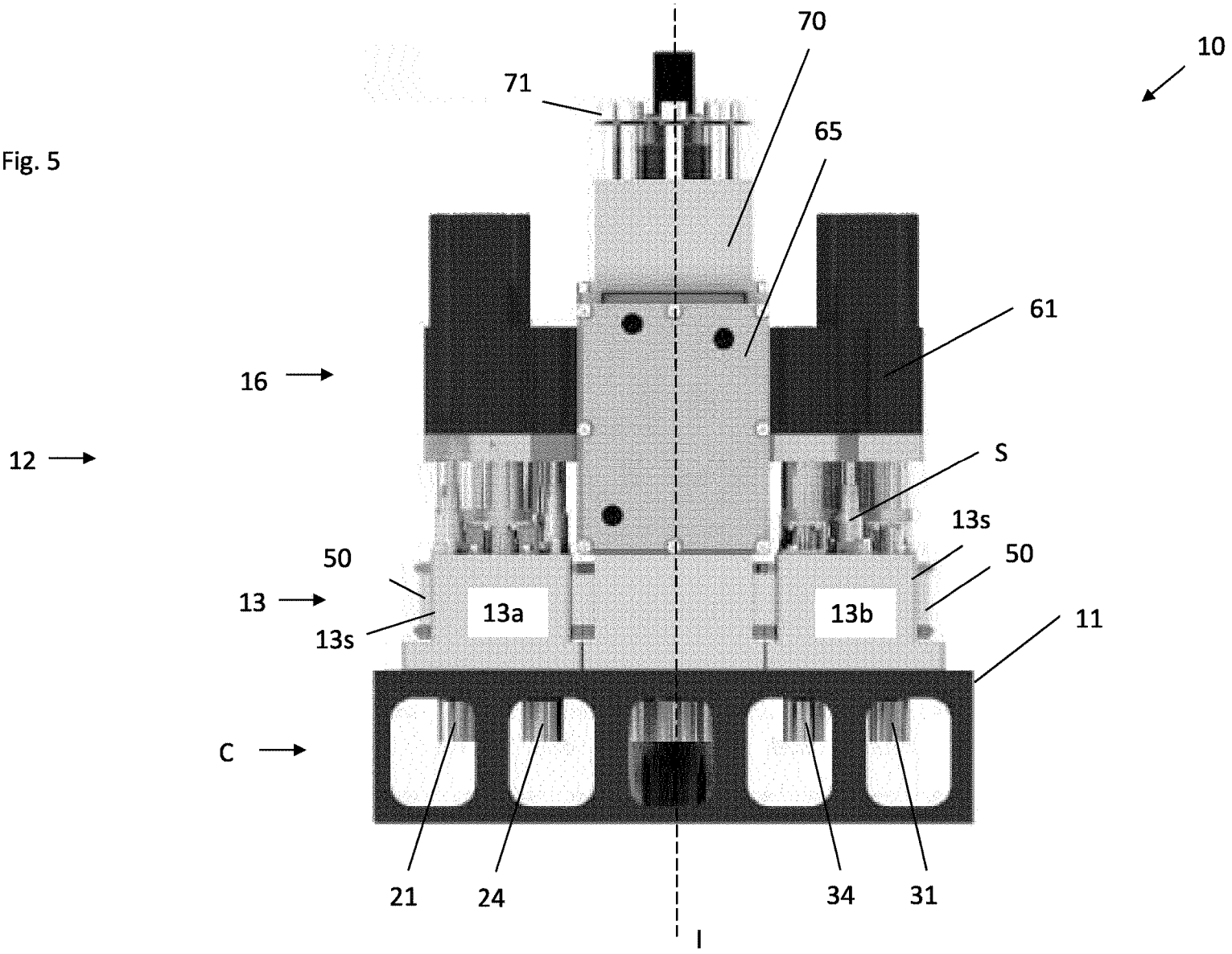
FIG. 5 illustrates a side view of the subsea hydraulic control device of FIG. 4.

It is now referred to FIGS. 3, 4 and 5. FIG. 3 shows the outside appearance of a subsea hydraulic control device 10 comprising a housing H and hydraulic connectors C protruding from the lower side of the device 10. The housing H is forming an outer pressure barrier for protection of the components of the hydraulic control device 10.

It is now referred to FIGS. 4 and 5, where the housing H has been removed from the device 10.

The device 10 comprises a base structure 11 in the form of a base plate and a hydraulic distribution unit 12 mounted to the base plate 11. The connectors C are protruding down from the hydraulic distribution unit 12. These connectors C can be one or a plurality of low pressure hydraulic input ports 21, low pressure hydraulic output ports 24, high pressure hydraulic input ports 31 and high pressure hydraulic output ports 34. These connectors C can also be one or a plurality of return fluid ports 41, or high pressure/low pressure return fluid ports 41*a*, 41*b* (even if these reference numbers are not shown in FIG. 4), which will be apparent from the description below. These connectors C are provided for connection to the subsea module 2, for example via a connection interface XTCI (Christmas Tree Connection Interface) or another type of connection interface. Alternately, some of the connectors C may be provided on top of, or on the side of, the device 10. Typically, the connectors C will be connected to the subsea module 2 via hydraulic fluid lines or jumpers in such a case. In addition, the connectors C may comprise electric power connectors for supplying electric energy to the device 10, for example to electric motors operating the valves. The connectors C may also comprise communication connectors for transferring communication signals and control signals between the device 10 and the module 2, and further to topside.

The hydraulic distribution unit 12 comprises a valve unit generally indicated with arrow 13 and a valve actuator unit generally indicated with arrow 16. There are one of each on both sides of the unit. The valve unit 13 comprises several control valves 14, provided within the valve unit 13. A stem S of the control valve 14 is shown in FIGS. 4 and 5 protruding upwardly from the valve unit 13, where the stem S is connectable to a valve actuator 61 of the valve actuator unit 16. Several valve actuators 61 are shown in FIG. 4, each of them are connected to a stem S of a control valve 14 located within the valve unit 13. The valve actuator 61 may for example be an electric motor, such as an electric servo motor. The valve actuator 16 may also be another type of actuating device.

The valve actuator unit 16 further comprises a control system housing 65 in which a control system is provided for controlling the valve actuators 61. The control system comprises an control circuit for controlling the electric motors either by means of hardware circuits and/or by means of software running on a digital signal processor.

The control valves 14 are also shown in FIGS. 9*a* and 9*b*, where the stem S is protruding upwardly. Rotation of the stem S will control the control valve 14 between its different positions or states. In FIG. 9*a*, the control valve 14 is connected to three different fluid lines; the first fluid line being a low pressure fluid line 22 in fluid communication with the low pressure fluid input port 21, the second fluid line being connected to the low pressure output port 24 and the third fluid line being a low pressure return fluid line 42*a* being connected to a low pressure return fluid port 41*a*. In FIG. 9*b*, the control valve 14 is also connected to three different fluid lines; the first fluid line being a high pressure fluid line 32 in fluid communication with the high pressure fluid input port 31, the second fluid line being connected to the high pressure output port 34 and the third fluid line being a high pressure return fluid line 42*b* being connected to a high pressure return fluid port 41*b*. The control valves in FIGS. 9*a* and 9*b* have the same physical properties. Hence, the same control valve 14 can be connected to both high pressure fluid lines and low pressure fluid lines, which will be described in detail below. It should be noted that the fluid lines described above are at least partially provided within the valve unit 13.

When the valve 14 of FIG. 9*a* is in its first position, low pressure fluid is supplied from the low pressure fluid input port 21 to the low pressure output port 24. Here, the valve port connected to the return fluid line 42*a* is closed. When the valve 14 is in its second position, fluid is allowed to return from the low pressure output port 24 to the return fluid line 42*a*. Here, the valve port connected to the low pressure input port 21 is closed.

When the valve 14 of FIG. 9*b* is in its first position, high pressure fluid is supplied from the high pressure fluid input port 31 to the high pressure output port 34. Here, the valve port connected to the return fluid line 42*b* is closed. When the valve 14 is in its second position, fluid is allowed to return from the high pressure output port 34 to the return fluid line 42*b*. Here, the valve port connected to the high pressure input port 31 is closed.

It is now referred to FIGS. 4, 5 and 10 again. The device 10 also comprises a supporting structure 70 connected to the base structure 11. The supporting structure 70 may comprise a connection interface for connection to a ROV handle HA shown in FIG. 3, used when the device 10 is lifted down to or up from the subsea module 2. Alternatively, the supporting structure 70 comprises a connection interface 71 for connection to the outer housing H shown in FIG. 3, where the ROV handle is connected to the outer housing H. One of the purposes of the supporting structure 70 is to provide support between the base plate 11 and the ROV handle. Preferably, the supporting structure 70 is connected to the center of the base structure 11, where the center of the base structure is indicated with vertical center line I in FIGS. 5 and 10. A horizontal center line L is also indicated in FIGS. 4 and 10, separating the base structure 11 into two half sections and intersecting the vertical center line I.

In the drawings, it is shown that the valve unit 13 is separated into two sub-units 13*a* and 13*b* connected separately to the base structure 11 on the respective side of the supporting structure 70. Hence, the first sub-unit 13*a* is connected to the base structure 11 on the first side of the center line L and the second sub-unit 13*b* is connected to the base structure 11 on the second side of the center line L.

The valve unit 13, or each of the sub-units 13, comprises a connection surface 13*s*. The manifold unit 50 is connected to the connection surface 13*s* of the valve unit 13. The above-mentioned fluid lines are guided out from the valve unit 13 to the connection surface 13*s* and further into the manifold unit 50 in a manner which will be described in detail below. As shown in FIGS. 4, 5 and 10, the connection surface 13*s* is accessible after the valve unit 13, the supporting structure 70 and the valve actuation unit 16 have been mounted to the base structure 11. Hence, the operation of mounting the manifold unit 50 to the valve unit 13 can be one of the final operations during the assembly of the device 10.

Initially, it is not specified if each output port is a low pressure output port 24 or if it is a high pressure output port 34. Hence, the output ports can generally be referred to as output ports 24, 34.

The configuration of the manifold unit 50 determines which of the output ports 24, 34 are low pressure output ports 24 connected to the low pressure fluid line 22 and which of the output ports 24, 34 being a are high pressure output ports 34 connected to the high pressure fluid line 32.

Hence, after configuration of the manifold unit 50 and connection of the manifold unit 50 to the valve unit 13, the output ports 24, 34 are specified to be either a low pressure output port 24 or high pressure output port 34.

The connection surface 13*s* can be provided on side surface of the valve unit 13 (i.e. a vertical surface), alternatively on a top surface (i.e. a horizontal surface) or an inclining surface.

It is now referred to FIG. 6*a*. Here, the hydraulic fluid lines of the hydraulic distribution unit 12 is shown. Some of these fluid lines are provided in valve unit 13, while others are provided in the manifold unit 50. Those fluid lines provided in the manifold unit 50 are shown within the dashed box 50 of FIG. 6, those fluid lines provided below the dashed box 50 are provided within the valve unit 13.

In addition to fluid lines, the valve unit 13 here comprises six control valves 14. In addition, the valve unit 13 comprises two dump valves 45 (also referred to as quick dump valves QDV) and two selector valves 43. Dump valves and selector valves are considered known for a person skilled in the art and will not be described here in detail.

The connection interface formed by the connectors C is also indicated as a dot-dot-dashed line in FIG. 6*a*. The connectors C here comprises two low pressure input ports 21, four low pressure output ports 24, two high pressure input ports 31 and two high pressure output ports 34. In addition, the connectors C comprise a return fluid port 41. There are two high pressure input ports 31 and two low pressure input ports 21 for the purpose of redundancy. The two high pressure input ports 31 are connected to one of the selector valves, which selects which of the high pressure input ports 31 is connected to the fluid line 32. In the same way, the two low pressure input ports 21 are connected to the other of the selector valves, which selects which of the low pressure input ports 21 is connected to the fluid line 22. It should therefore be noted that there could be only one high pressure input port 31 and one low pressure input port 21 among the connectors C.

Below the connection interface C, some fluid lines of the subsea module 2 are indicated. These fluid lines are again connected to a low pressure fluid source LP, a high pressure fluid source HP, a return fluid reservoir R and a number of actuators A. The low pressure and high pressure fluid sources LP, HP are considered known and may be located topside (connected to the subsea module 2 via the umbilical shown in FIG. 1) or on the seabed. The return fluid reservoir R may be a fluid reservoir located topside (again connected via the umbilical) or on the seabed. The return fluid reservoir R may also be a fluid line which is fed back to the low pressure fluid source and/or the high pressure fluid source. If the fluid is considered environmentally friendly, the return fluid may also be dumped to sea. Hence, the sea may be defined to be one possible embodiment of the return fluid reservoir R. The actuator A may be an actuator for moving a subsea valve (not shown) between its open and closed states, typically by means of a linear movement. The actuator is typically biased to be default closed or default open by means of a spring etc. The low pressure or high pressure fluid has a pressure sufficient to counteract the biasing force of the spring. Hence, when the control valve 14 is in its first position, fluid is supplied to the actuator and the biasing force is counteracted. However, when the control valve is in its second position, the biasing spring will press the fluid up through the control valve again to the return fluid line and further to the return fluid reservoir. Some such actuators require a high pressure fluid to counteract its biasing force while other actuators require a low pressure fluid. It should be noted that the high pressure fluid and the low pressure fluid have a fluid pressure higher than the fluid pressure of the return fluid line. The actuators may be downhole valves, valves in the Christmas tree (which is one example of a subsea module 2), manifold valves, chokes etc.

In FIG. 6*a*, there is one solid line indicated by arrow 22, representing the above-mentioned low pressure fluid line for transporting low pressure fluid from the (or one of the) low pressure fluid sources LP via the low pressure input port 21 and further to the control valves 14 being connected to the fluid line 22. There is another solid line indicated by arrow 32, representing the abovementioned high pressure fluid line for transporting high pressure fluid from the (or one of the) high pressure fluid sources HP via the high pressure input port 31 and further to the control valves 14 being connected to the fluid line 32. When the control valves 14 are in their first state, fluid is supplied to their respective actuators via output ports 24, 34.

In FIG. 6*a*, there is also a dashed line 42 representing the above-mentioned return fluid line connected to the control valves 14. When the control valves 14 are in their second state, fluid is pressed from the actuators via the output ports 24, 34 (here serving as return ports) through the control valves and further to the return fluid line 42, connected to a return port 41 of the hydraulic distribution unit. In FIG. 6*a* the device 10 has four low pressure output ports 24 and two high pressure output ports 34.

The manifold unit 50 is shown with a dashed area hereinafter referred to as a separation area 51. The separation area 51 is separating the high pressure fluid line 32 from the low pressure fluid line 22 of the manifold unit 50. By moving the separation area 51 to another position, the number of low pressure output ports 24 and high pressure output ports 34 can be changed. In FIG. 6*b*, the separation area 51 has been moved, thereby achieving that the device 10 has three low pressure output ports 24 and three high pressure output ports 34. This reconfiguration can be achieved in a simple way by replacing the manifold unit 50 of FIG. 6*a* with the manifold unit 50 of FIG. 6*b*, but keeping the rest of the configuration of the hydraulic control device. A software update of the control system within the control system housing may also be performed based on the reconfigured manifold unit. However, such a software update is not needed for the purpose of controlling how to rotate the stem of a valve, as the control of the rotation of a stem of a valve being connected to a high pressure fluid line is identical to the rotation of a stem of a valve being connected to a low pressure fluid line.

It is now referred to FIG. 7, which is similar to FIG. 6*a*. Only the differences with respect to FIG. 6*a* will be described in detail below. In FIG. 6*a*, the return fluid line 42 is provided as one common return fluid line bore B42 for all control valves 14 in the manifold unit 50 and the separation area 51 is only separating the high pressure fluid line 32 from the low pressure fluid line 22.

In FIG. 7, the separation area 51 is separating also the return fluid line 42 into two different sections 42*a*, 42*b*. Accordingly, there are two return fluid ports 41*a*, 41*b*. Here, fluid returned from the low pressure output ports 24 are returned via the first return fluid line 42*a* to the first return fluid port 41*a* while fluid returned from the high pressure output ports 34 are returned via the second return fluid line 42*b* to the second return fluid port 41*b*. Here, there are two return fluid reservoirs as well a low pressure return fluid reservoir RLP and a high pressure return fluid reservoir RHP.

It is now referred to FIG. 11*a-g*, where the manifold unit 50 is shown in detail. The manifold unit 50 has the shape of a rectangular plate having a front surface 50*a*, a rear surface 50*b* for connection to the connection surface 13*s* of the valve unit 13, and end surfaces 50*c*, 50*d*. The manifold unit 50 comprises a plurality of connection bores 52 from the front side 50*a* to its rear side 50*b* for screws or bolts, for releasable connection of the manifold unit 50 to the valve unit 13.

In addition, the fluid lines 22, 32 and 42 are provided as bores in the manifold unit 50. One section of the low pressure fluid line 22 is provided as a first fluid bore B22 in the manifold unit 50. One section of the high pressure fluid line 32 is provided as a second fluid bore B32 in the manifold unit 50. It is now referred to FIG. 11*b*. Here, the first fluid bore B22 is shown to be aligned with the second fluid bore B32 along a common axis 150. This gives a very easy reconfiguration of high pressure and low pressure control valves. The first fluid bore B22 is drilled with a first length L1 from the first end surface 50*c* and the second fluid bore B32 is drilled with a second length L2 from the second end surface 50*d* opposite of the first end surface 50*c*. The respective first and second lengths L1, L2 of the first and second bores B22, B32 determine which of the output ports 24, 34 are the low pressure output ports 24 connected to the low pressure fluid line 22 and which of the output ports 24, 34 are the high pressure output ports 34 connected to the high pressure fluid line 32. As shown in FIG. 11*d*, the separation area 51 is provided as an area along line 150 of the manifold unit 50 in which no bores have been drilled.

A section of the return fluid line 42 is provided as one bore B42 (FIG. 6*a*, 6*b*) or as bores B42*a*, B42*b* (FIG. 7, FIG. 11*b*, FIG. 11*g*) in the manifold unit 50. The return fluid bore B42 or bores B42*a*, B42*b* are preferably provided in parallel with the bores B22, B32 and are preferably made according to one of the methods described above for the bores B22, B32.

The bores B22, B32 are preferably provided in a longitudinal direction of the manifold unit 50, i.e. substantially in parallel with the connection surface 13*s* of the valve unit 13.

An alternative embodiment is shown in FIG. 11*e*. Here, the bores B22, B32 are provided as one through bore from the first side 50*c* to the second side 50*d* and the bore B42 is provided as one through bore from the first side 50*c* to the second side 50*d*. Here, the separation between the low pressure fluid line and the high pressure fluid line is achieved by means of a sealing element 51*a* inserted into each through bore, where each sealing element 51 is preventing fluid flow in the bore between the low pressure side and the high pressure side. The sealing elements 51*a* may be pushed into its desired location in the bore. If a reconfiguration of the device 10 is desired, the manifold unit is disconnected from the valve unit 13, and the sealing elements 51*a* is pushed into its new desired location in the bore or a new manifold is connected. It might even be possible to perform this reconfiguration without disconnecting the manifold unit 50 from the valve unit 13.

The manifold unit 50 comprises further bores for connecting the bores B22, B32, B42 (alternatively bores B22, B32, B42*a*, B42*b*) to the valve unit 13. As the rear surface 50*b* is provided in contact with the connection surface 13*s* of the valve unit 13, and as the fluid lines of the valve unit 13 is provided out towards the connection surface 13*s*, these further bores are provided between the bores B22, B32, B42 (alternatively bores B22, B32, B42*a*, B42*b*) and the rear surface 50*b* of the manifold unit 50.

These further bores are generally indicated in FIG. 11*f* as bores X and Y, where the bores X are high pressure/low pressure fluid lines, and bores Y are return fluid lines. This will be described further in detail below. First, it should be noted that suitable sealing elements (not shown) such as o-rings etc. are provided to prevent fluid leakages between the bores in the connection interface between the connection surface 13*s* and the rear surface 50*b* of the manifold unit 50. Preferably, these bores are perpendicular to the bores B22, B32, B42 (alternatively bores B42*a*, B42*b*).

In the above embodiments, the openings into the bores B22, B32, B42 (or B42*a*, B42*b*) from the respective end surfaces 50*c*, 50*d* of the manifold unit 50 are sealed, as these openings are not used in the embodiments shown in FIG. 6*a*, 6*b*, 7. It is now referred to FIG. 8. Here it is shown that the low pressure fluid port 21 is connected to the low pressure fluid line 22 and the low pressure return fluid port 41*a* is connected to the low pressure return fluid line 42*a* via the openings in the first end surface 50*c* of the manifold unit 50. In similar way, it is shown that the high pressure fluid port 31 is connected to the high pressure fluid line 32 and the high pressure return fluid port 41*b* is connected to the high pressure return fluid line 42*b* via the openings in the second end surface 50*d* of the manifold unit 50.

It is now referred to FIG. 7, FIGS. 11*f* and 11*g*.

One bore B25 is provided in the manifold unit 50 for connecting the first (or low pressure) bore B22 to the low pressure input fluid port 21 via the valve unit 13.

One or more bores B26 are provided in the manifold unit 50 for connecting the first (or the low pressure) bore B22 of the manifold unit 50 to the respective control valves 14 of the valve unit 13.

One bore B35 is provided in the manifold unit 50 for connecting the second (or high pressure) bore B32 to the high pressure input fluid port 31 via the valve unit 13.

One or more bores B36 are provided in the manifold unit 50 for connecting the second (or high pressure) bore B32 of the manifold unit 50 to the different respective control valves 14 of the valve unit 13.

The above bores B26, B36, B25, B35 are forming the bores X in FIG. 11*f*.

One bore B43*a* is provided in the manifold unit for connecting the first (or low pressure) return bore B42*a* to the low pressure return fluid port 41*a* via the valve unit 13.

One or more bores B44*a* are provided in the manifold unit 50 for connecting the respective control valves 14 to the low pressure return bore B42*a*.

One bore B43*b* is provided in the manifold unit for connecting the second (or high pressure) return bore B42*b* to the high pressure return fluid port 41*b* via the valve unit 13.

One or more bores B44*b* are provided in the manifold unit 50 for connecting the respective control valves 14 to the high pressure return bore B42*b*.

The above bores B43*a*, B43*b*, B44*a*, B44*b* are forming the bores Y in FIG. 11*f*.

In the embodiment of FIG. 6*a*, the manifold unit 50 will be different, as there is no difference between bores B44*a* and B44*b*, and as there is only one bore B43 for connection of the common return fluid bore B42 to the common return fluid port 41.

In the above embodiments, the manifold unit 50 is provided as one single body serving the purpose of configuring the number of low pressure output ports and the number of high pressure output ports. One exception is the embodiment of FIG. 11*e*, where separate sealing elements 51*a* are used.

If a reconfiguration of the device 10 is desired, the manifold unit 50 is disconnected from the valve unit 13, and replaced with a different manifold unit 50 with different bores or a different location of the sealing elements 51*a*. Hence, if there is a need for reconfiguring the output ports in the final stages of the manufacturing process, this can be achieved within a time frame of minutes or hours, not within a time frame of weeks, as with some prior art devices.

It is now referred to FIG. 12*a*. Here, the manifold unit 50 is shown connected to the valve unit 13, with low pressure fluid lines 22 and high pressure fluid lines 32 from the valve unit 13 and into the manifold unit 50. As in FIG. 7, the return fluid line is separated into a low pressure return fluid line 42*a* and a high pressure return fluid line 42*b*. There are seven valve units which here are denoted F1-F7 connected between the low pressure fluid line 22, the low pressure return fluid line 42*a* and the low pressure output ports (not shown in FIG. 12*a*). There are three valve units which here are denoted F8-F10 connected between the high pressure fluid line 32, the high pressure return fluid line 42*b* and the high pressure output ports (not shown in FIG. 12*a*).

In the embodiment of FIG. 12*a*, the quick dump valve 45 is connected in a side branch of the low pressure fluid line 22 in the valve unit. The quick dump valve 45 is not directly connected to the other valve elements through the manifold unit 50 itself.

An alternative embodiment to FIG. 12*a* is shown in FIG. 12*b*. FIG. 12*b* corresponds to FIG. 12*a* and only the differences will be described herein. In FIG. 12*b*, the quick dump valve 45 is connected between the low pressure fluid line 22 of the valve unit 13 and further via the manifold unit 50 to the first and second valve units F1 and F2. Hence, the first and second valve units F1 and F2 are supplied with low pressure fluid via the quick dump valve 45 while the remaining valve units F3 F7 are supplied with low pressure fluid directly from the low pressure3 fluid line 22 (i.e. not via the quick dump valve 45). As shown in FIG. 12*b*, there are now three parallel bores in parts of the manifold unit 50. By such a configuration of the bores in the manifold unit 50 one may select which of the valves should be linked to the quick dump valve. This gives the possibility of easy adaptation at a late stage in the assembly/production of the control device.

The invention claimed is:

1. A subsea hydraulic control device for hydraulically controlling a subsea module, the control device including a hydraulic distribution unit comprising:

a valve unit;

a manifold unit;

a low pressure hydraulic input port connectable to a low pressure fluid source and connected to a low pressure fluid line within the hydraulic distribution unit;

a high pressure hydraulic input port connectable to a high pressure fluid source and connected to a high pressure fluid line within the hydraulic distribution unit;

a return port connectable to a return fluid reservoir and connected to a return fluid line within the hydraulic distribution unit; and a number of hydraulic output ports connectable to subsea actuators of the subsea module;

wherein the valve unit comprises a number of control valves, each of which is connected either between the low pressure fluid line, the return fluid line and one of the output ports or between the high pressure fluid line, the return fluid line and one of the output ports;

wherein the manifold unit comprises sections of the low pressure and high pressure fluid lines for distributing fluid from the input ports to the respective control valves;

wherein a section of the low pressure fluid line is provided as a first fluid bore in the manifold unit and a section of the high pressure fluid line is provided as a second fluid bore in the manifold unit; and wherein the configuration of the first and second fluid bores in the manifold unit determines which of the output ports are low pressure output ports connected to the low pressure fluid line and which of the output ports are high pressure output ports connected to the high pressure fluid line.

2. The subsea hydraulic control device according to claim 1, wherein the manifold unit is releasably connected to the valve unit.

3. The subsea hydraulic control device according to claim 1 further comprising:

a lower base plate to which the valve unit is mounted;

wherein the manifold unit is connected to a connection surface of the valve unit.

4. The subsea hydraulic control device according to claim 3, wherein the connection surface of the valve unit is accessible for connection of the manifold unit to the valve unit when the valve unit is mounted to the lower base plate.

5. The subsea hydraulic control device according to claim 1, further comprising a valve actuator unit comprising a number of valve actuators, each of which is connected to a stem of a respective control valve of the valve unit.

6. The subsea hydraulic control device according to claim 1, wherein the first fluid bore is aligned with the second fluid bore along a common axis, and wherein respective first and second lengths of the first and second bores determine which of the output ports being are the low pressure output ports connected to the low pressure fluid line and which of the output ports being are the high pressure output ports connected to the high pressure fluid line.

7. The subsea hydraulic control device according to claim 1, wherein a first section of the return fluid line is provided as a first return fluid line bore in the manifold unit and a second section of the return fluid line is provided as a second return fluid line bore in the manifold unit.

8. The subsea hydraulic control device according to claim 1, wherein the fluid lines of the valve unit are guided into the manifold unit via bores provided between a rear surface of the manifold unit facing towards the valve unit and the first and second fluid bores and via bores provided between the rear surface and the return fluid line bore.

9. A method for production of a control device for hydraulically controlling a subsea module, the method comprising the initial steps of:

providing a hydraulic distribution unit comprising a valve unit having a number of control valves and fluid lines;

providing the hydraulic distribution unit with a low pressure hydraulic input port connected to a low pressure fluid line within the hydraulic distribution unit, wherein the low pressure hydraulic input port is connectable to a low pressure fluid source;

providing the hydraulic distribution unit with a high pressure hydraulic input port connected to a high pressure fluid line within the hydraulic distribution unit, wherein the high pressure hydraulic input port is connectable to a high pressure fluid source;

providing the hydraulic distribution unit with a return port connected to a return fluid line within the hydraulic distribution unit, wherein the return port is connectable to a return fluid reservoir;

providing the hydraulic distribution unit with a number of hydraulic output ports connectable to corresponding subsea actuators of the subsea module;

wherein the method further comprises the subsequent steps of:

providing a manifold unit comprising sections of the low pressure and high pressure fluid lines for distributing fluid from the input ports to the respective control valves;

providing bores in the manifold unit, wherein the respective bores in the manifold unit determine which of the output ports are low pressure output ports connected to the low pressure fluid line and which of the output ports are high pressure output ports connected to the high pressure fluid line; and connecting the manifold unit to the valve unit.

10. The method according to claim 9, further comprising the step of:

connecting a valve actuator unit comprising valve actuators to stems of the respective control valves protruding from the valve unit.

* * * * *